US005564358A

United States Patent [19]

Newton

[11] Patent Number: 5,564,358

[45] Date of Patent: Oct. 15, 1996

[54] OVER AND UNDER BOAT COVER

[76] Inventor: Donald R. Newton, 3901 N. Kickapoo, No. 11, Shawnee, Okla. 74801

[21] Appl. No.: 523,244

[22] Filed: Sep. 5, 1995

[51] Int. Cl.[6] ..... B63B 17/00

[52] U.S. Cl. ..... 114/361; 150/166

[58] Field of Search ..... 114/361, 343; 150/166; 296/136; 280/414.1

[56] References Cited

U.S. PATENT DOCUMENTS

| | | | |
|---|---|---|---|
| 3,746,366 | 7/1973 | Bruce et al. | 293/112 |
| 4,223,414 | 9/1980 | Dickson . | |
| 4,694,774 | 9/1987 | Keithley, Jr. | 114/361 |
| 4,815,412 | 3/1989 | Cassaro, Jr. | 114/343 |
| 4,840,400 | 6/1989 | Greenleaf | 293/112 |
| 4,962,719 | 10/1990 | Hughes et al. | 114/343 |
| 4,995,329 | 2/1991 | Kleine | 114/361 |
| 5,076,195 | 12/1991 | Heyne | 114/361 |
| 5,228,408 | 7/1993 | Jannausch | 114/361 |
| 5,291,848 | 3/1994 | Wilhelm et al. | 114/361 |

FOREIGN PATENT DOCUMENTS

| | | | |
|---|---|---|---|
| 1176537 | 10/1984 | Canada | 114/361 |

*Primary Examiner*—Jesus D. Sotelo

*Attorney, Agent, or Firm*—Dougherty, Hessin, Beavers & Gilbert

[57] ABSTRACT

A protective boat cover for trailered craft which consists of a top cover for secure positioning over the topside of the boat in combination with a cushioning bow cover extending over the forward underside of the boat to deflect and protect against roadway debris.

10 Claims, 3 Drawing Sheets

OVER AND UNDER BOAT COVER

BACKGROUND OF THE INVENTION

1. Field of the Invention

The invention relates generally to small craft protective covers and, more particularly, but not by way of limitation, it relates to an improved boat cover combination that combines detachably a boat top cover with an underside bow cover.

2. Description of the Prior Art

The prior art discloses various forms of hull top cover and a lesser number of underside boat covers but there is no showing of an over and under cover combination as arrayed in detachable formation. The U.S. Pat. No. 4,995,329 provides a general teaching of a hull top cover that may be placed over the entire length of the boat and secured either around the hull or to an associated trailer with shock cord or the like. Such a boat cover affords good, secure topside protection against the elements while isolating all interior spaces. A U.S. Pat. No. 5,076,195 provides an illustrative showing of one form of bow cover which is maintained in position over a boat bow by means of shock fasteners as it functions to protect against road material when the boat is being trailed. There are a number of such devices taught in the prior art for either top board protection or underside hull protection; however, Applicant knows of no combination teaching, especially a detachable combination, as taught by the present invention.

SUMMARY OF THE INVENTION

The present invention relates to an improved form of boat cover that is useful in particular for small craft that are trailered on the roadway. The boat cover consists of a top cover formed of a protective material that can be drawn tightly around its periphery to envelop the topside portion of the boat from stem to stern, generally seizing over the boat gunnel areas. The cover further includes an underside bow cover secured around the forward periphery of the top cover thereby to provide further protection from roadway debris and the like during trailering. The underside bow cover may be formed in various modes of detachability thereby to provide maximum accommodation to the boat operator. The over and under type of boat cover is adaptable to most any size of watercraft from the minimal length personal watercraft on up to the largest trailerable inboard or outboard boats.

Therefore, it is an object of the present invention to provide a cover for trailered boats that protects from roadway debris as well as the elements.

It is also an object of the invention to provide an underside bow cover that is detachable from the top cover and easily installable in combination.

It is yet further an object of the present invention to provide a protective cover that is lightweight and easily stowed yet offers bow underside protection from flying debris encountered on the roadway.

Finally, it is an object of the present invention to provide a boat cover that is easily installed or placed in operation by handling of one person.

Other objects and advantages of the invention will be evident from the following detailed description when read in conjunction with the accompanying drawings that illustrate the invention.

DETAILED DESCRIPTION OF THE INVENTION

Figure 1:
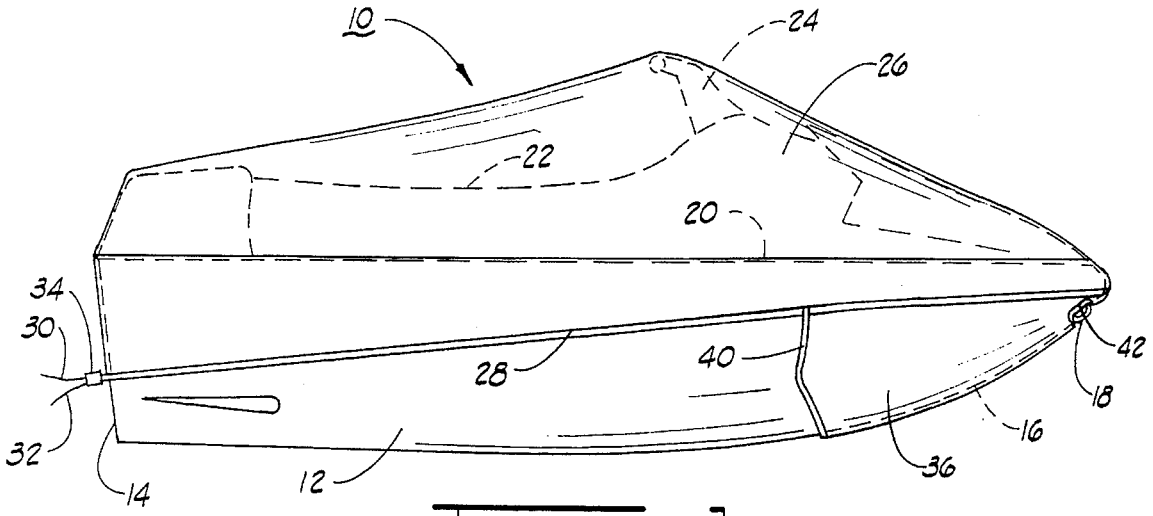
FIG. 1 is a side view in elevation of a small craft with the top cover and bow cover installed.

Referring to FIG. 1, a protective boat cover 10 is shown in secured position over a small craft. In this case, the small craft is a jet-type craft of the WAVE VENTURE™ type having a hull 12, stern 14 and bow 16 which includes a bow securing eye 18. The hull 12 is formed generally with a gunnel 20 on each side and a midships located seat 22 disposed aft of a steering column 24.

The boat cover 10 includes a top cover 26 which extends down over gunnel structure 20 from bow 16 to stern 14. A peripheral folded seam 28 is formed around the edge of boat cover 26 and drawstrings 30 and 32 are threaded through the folded seam 28 so that it can be drawn tightly around the hull 12 below the gunnel 20. A suitable form of slide lock 34 can then be secured to cinch the drawstrings 30 and 32 tightly around the hull 12.

A bow cover 36 is secured over the forward underside of hull 12 and secured along seam section 38 to depend from the forward portion of boat cover 10. A reinforcing hem 40 is formed along the back edge of bow cover 36 as an access hole is formed by a hem 42 forward to provide access to the bow eye 18. The bow cover 36 may be securely stitched or detachably affixed along forward seam section 38, as will be further described below.

The top cover 26 may be formed from canvas, vinyl or other conventional protective material, the primary function being to isolate the craft interior from insects, rodents and inclement weather. The bow cover 36 is preferably formed from a heavier material such as a commercially available, one or two-ply padded vinyl that protects and provides cushioning against striking road debris deflected upward from the roadway. Such padded vinyl is referred to as breathable, heavy gauge vinyl with padding and is available from Haartz Corp. of Alton, Mass.

Figure 2:
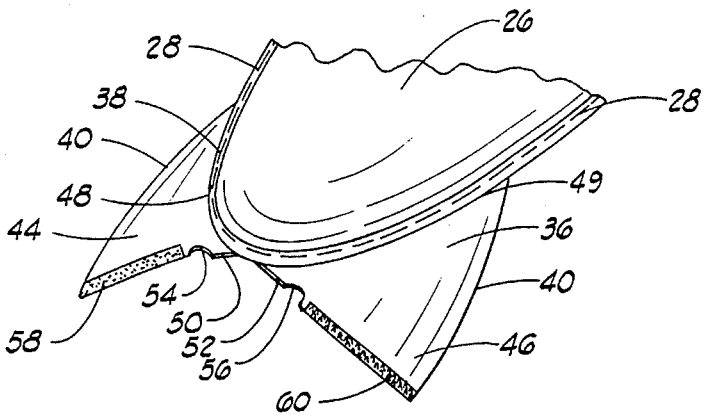
FIG. 2 is a perspective view of the bow portion of a boat cover with a first alternative form of bow cover fastening.

FIG. 2 shows a first scheme for affixing the bow cover 36 to the top cover 26. The bow cover 36 is formed in first and second halves 44 and 46 with respective upper edges 48 and 49 secured to top cover 26 as by stitching around the forward bow portion 38 of folded seam 28. The bow cover 46 is then cut and hemmed along the vertical stem line to form stem edges 50 and 52. The stem edges 50 and 52 are then further seamed to form access holes 54 and 56 with a suitable fastener such as pile strip 58 and hook strip 60 secured along opposite lower edges of the stem seam 50 and 52, respectively.

In operation, the operator or attendant simply pulls the top cover 10 on over the front nose of the small craft and rearward until completely covering the craft. The top cover 26 is secured in place by tightening the drawstrings 30 and 32 and cinching with the slide fastener 34. Then, it is only necessary to close the bow cover flaps 44 and 46 around under the bow 16 of the hull 12, carefully securing the hook strip 60 into the pile strip 58 while aligning the access holes 54 and 56 over the bow eye 18. The small craft is then road ready and protected from both the topside and the leading bottom side.

Figure 3:
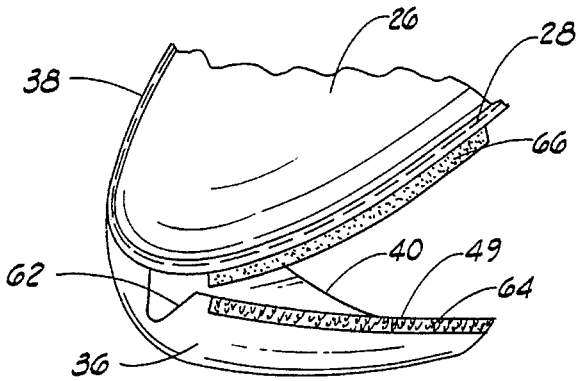
FIG. 3 is a perspective view of a boat cover bow portion with a second alternative form of bow cover fastening.

FIG. 3 shows yet another scheme for the attachment of bow cover 36 to top cover 26. In this case, the starboard side of bow cover 36 is attached by stitching around the starboard quarter of top cover 26. A slot 62 in bow cover 36 remains for exposure of bow eye 18 as the port side of bow cover 36 with hook strip 64 is inserted and secured behind pile strip 66 thereby to secure the bow cover 36 in operative coactive position. While the application speaks of VELCRO™ type fasteners, it should be understood that snaps, zippers or combinations thereof may be used to good advantage.

Figure 4:
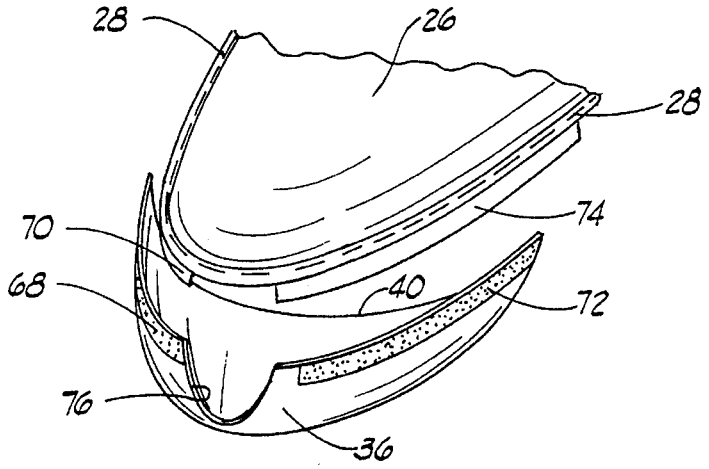
FIG. 4 is a perspective view of a boat cover bow portion showing a third form of bow cover fastening.

FIG. 4 illustrates yet another mode of attachment of bow cover 36 to the top cover 26. In this case, bow cover 36 is completely disengageable and can be fastened by means of a starboard hook strip 68 in engagement with a starboard pile strip 70, while port side hook strip 72 is engageable with port side pile strip 74. The bow cover 36 is then securely affixed below the bow end of top cover 26 while leaving the access hole 76 for receiving the bow eye 18 therethrough. The opposite side pile strips 70 and 74 may be secured around the starboard and port bow positions by stitching to the folded seam 28.

Figure 5:
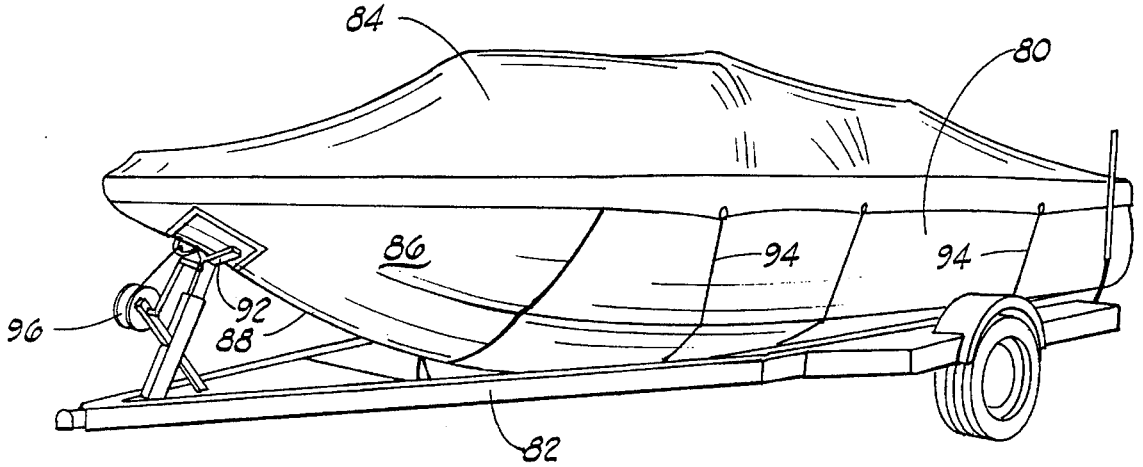
FIG. 5 is a perspective view of a larger type of small craft carried by a trailer with the over and under protective cover installed.

FIG. 5 illustrates a larger boat 80 as secured on a mobile trailer 82 while protected by a top cover 84 in combination with a bow cover 86. The boat top cover 84 may be installed or removed without interference while the boat 80 is secured on the trailer 82. After the top cover 84 and bow cover 86 are drawn snugly over the stern of boat 80, the array of shock cords 94 may be positioned and, thereafter, a cable from draw wheel 96 is secured to bow eye 98 and tightened to draw the boat stem 88 tightly into stem brace 92. The cable reel 96 can then be secured with the boat 80 tightly maintained road-ready on trailer 82.

Figure 6:
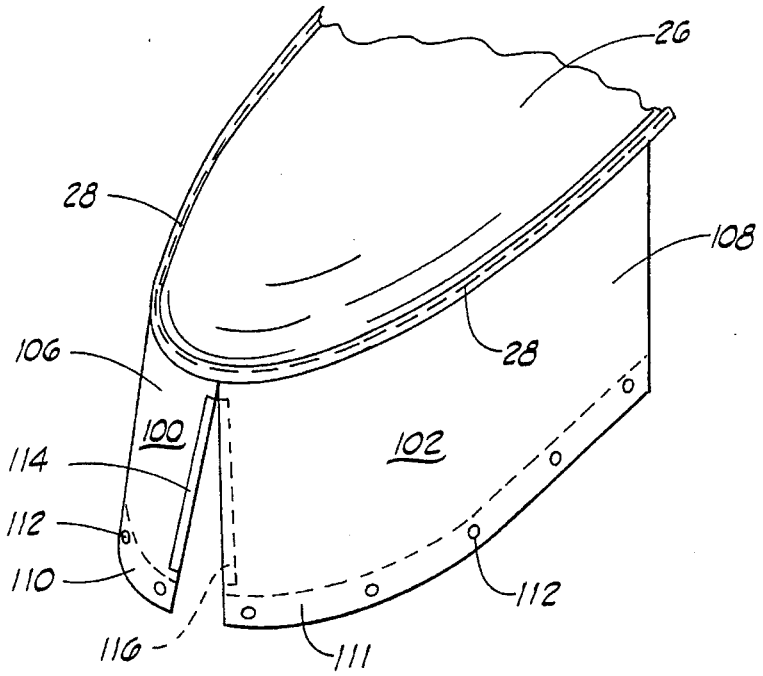
FIG. 6 is a perspective view of a boat cover bow portion with full side panels connectable from bow to the trailer frame.

Referring now to FIG. 6, a top cover 26 is shown in combination with bow side panel covers 100 and 102 that can be secured to the opposite side forward trailer chassis frames, as will be described. The opposite side panels 106 and 108 are secured around the bow of top cover 26 by stitching at the folded seam 28 as side panels 106 and 108 extend down to respective folded cuffs 110 and 111. The cuffs 110 and 111 are then secured to opposite chassis frames by suitable snap fasteners 112 or the like. The front flap may be secured by such as mating VELCRO™ fabrics 114 and 116. Use of the side panel covers 100 and 102 completely protects the forward boat hull from any debris or staining that may be contacted on the roadway.

Figure 7:
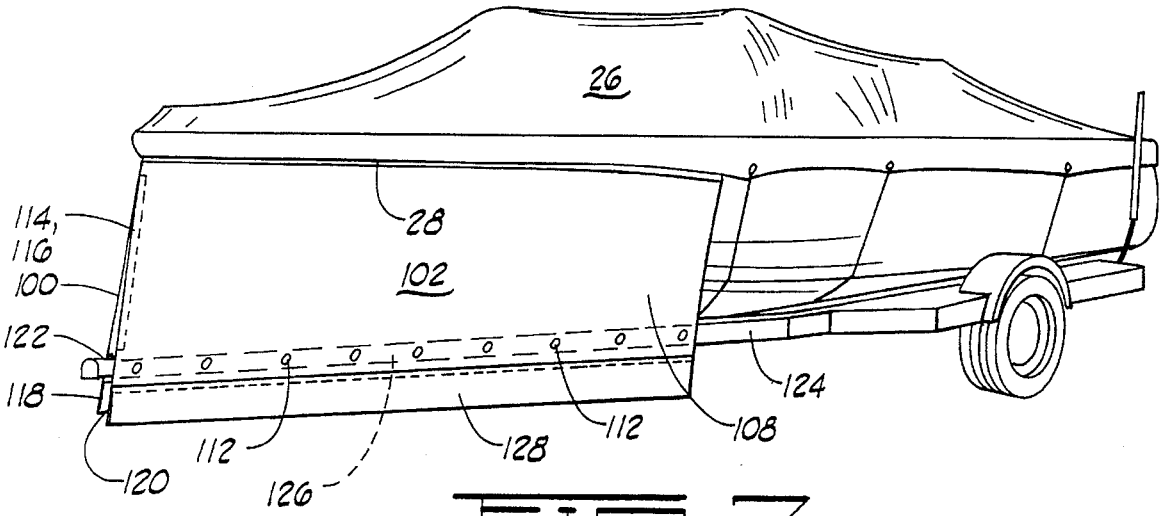
FIG. 7 is a perspective view of a boat trailer with forward deflector skirts secured to extend below the trailer frame.

FIG. 7 illustrates the bow side panel covers 100 and 102 and top cover 26 in operation while still another protective component is used. A pair of deflector skirts 118 and 120 may be utilized in combination with various boat covers as previously described to extend coverage completely down to the road surface. The deflector skirts 118 and 120 are secured along the forward chassis frames 122 and 124 by means of snap fasteners 112. The opposite side skirts 118 and 120 are each formed with a top seam 126 through which the eye portion of snap fasteners 112 is secured. The mating fastener posts may be secured along the chassis frames 122 and 124. A bottom (heavy, maybe even weighted) seam 128 is then formed along the bottom edge of skirts 118, 120 to ride close to the pavement or roadway.

The foregoing discloses a novel type of boat cover that provides protection from all of inclement weather, insects, airborne hazards, and roadway debris while a boat is being trailered. The cover design is adaptable to any size small craft and is functionally compatible with nearly all boat trailer designs that are utilized today. Such a combination top cover/bow cover is relatively lightweight and easily stowable for manipulation and further handling by one person for placement into operational mode.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A protective boat cover comprising:

a top cover of protective material of elongate shape having first and second sides and extending over a boat topside from stem to stern;

a folded seam sewn around the periphery of said top cover;

means for adjusting the length of said top cover periphery to enable a secure fit over the boat topside;

a bow cover of protective material having first and second sides for disposition over the boat forward underside; and means for securing said bow cover first and second sides to the forward first and second sides of said top cover.

2. A protective boat cover as set forth in claim 1 wherein:

said bow cover protective material is heavy grain, heavy gauge, vinyl with padded backing.

3. A protective boat cover as set forth in claim 1 wherein said means for adjusting comprises:

a peripheral drawstring enclosed within said folded seam with drawstring ends accessible to draw said top cover tightly over said boat topside; and means for cinching and holding the drawstring ends.

4. A protective boat cover as set forth in claim 3 wherein said means for securing comprises:

stitching a first bow cover side to a first forward side of said top cover; and releasably securing the second bow cover side to the opposite forward side of said top cover.

5. A protective boat cover as set forth in claim 3 wherein said means for securing comprises:

releasably securing the first bow cover side to a first forward side of said top cover; and releasably securing the second bow cover side to the opposite forward side of said top cover.

6. A protective boat cover as set forth in claim 1 wherein said means for securing comprises:

stitching the bow cover first and second sides to the forward first and second sides of the top cover at the folded seam.

7. A protective boat cover as set forth in claim 6 wherein said means for securing further comprises:

forming a vertical, quick releasable seam along the bow stem center line of said bow cover.

8. A protective boat cover as set forth in claim 1 wherein said means for securing comprises:

stitching a first bow cover side to a first forward side of said top cover; and releasably securing the second bow cover side to the opposite forward side of said top cover.

9. A protective boat cover as set forth in claim 1 wherein said means for securing comprises:

releasably securing the first bow cover side to a first forward side of said top cover; and releasably securing the second bow cover side to the opposite forward side of said top cover.

10. A protective cover for boat and trailer chassis, comprising:

a top cover of protective material of elongate shape having first and second sides and extending over a boat topside from stem to stern;

a folded seam sewn around the periphery of said top cover;

means for adjusting the length of said top cover periphery to cause a secure fit over the boat topside;

a bow cover of protective material having top and bottom edges with said top edge secured to said top cover around the stem; and means for securing said bow cover bottom edge to opposite sides of the trailer chassis.

* * * * *